United States Patent [19]

Campbell

[11] Patent Number: 4,467,781

[45] Date of Patent: Aug. 28, 1984

[54] SAFETY APPARATUS FOR PORTABLE FUEL-BURNING HEATERS

[76] Inventor: Robert H. Campbell, 103 Meadowbrook La., Brookhaven, Pa. 19015

[21] Appl. No.: 468,641

[22] Filed: Feb. 22, 1983

[51] Int. Cl.[3] ..... F24C 15/36

[52] U.S. Cl. ..... 126/201; 126/202; 237/79

[58] Field of Search ..... 126/201, 202, 203, 298, 126/120, 121, 66, 81, 22; 237/79; 52/69, 70; 220/4 B, 4 E, 19

[56] References Cited

U.S. PATENT DOCUMENTS

| | | | |
|---|---|---|---|
| 1,255,033 | 1/1918 | McNutt | 126/201 |
| 1,440,336 | 12/1922 | Buffington | 126/201 |
| 3,451,580 | 6/1969 | Husby | 220/4 B |
| 4,314,543 | 2/1982 | Bullington | 126/201 |

FOREIGN PATENT DOCUMENTS

| | | | |
|---|---|---|---|
| 99876 | 7/1961 | Netherlands | 126/67 |
| 708579 | 5/1954 | United Kingdom | 126/202 |
| 1512789 | 6/1978 | United Kingdom | 220/4 B |
| 2071309 | 9/1981 | United Kingdom | 126/202 |

*Primary Examiner*—James C. Yeung
*Attorney, Agent, or Firm*—Anthony J. McNulty

[57] ABSTRACT

A safety apparatus for portable, fuel-burning heaters is provided which comprises a foraminate container for enclosing the heater. The container includes a tray- or pan-like base having a rectangular back wall and obliquely-shaped side walls, a vaulted or domed lid comprising foraminous front and side wall portions which conform to and complement the walls of the base to yield an enclosable receptacle, and hinging means connecting the two along their mating front edges.

8 Claims, 6 Drawing Figures

Fig. 6
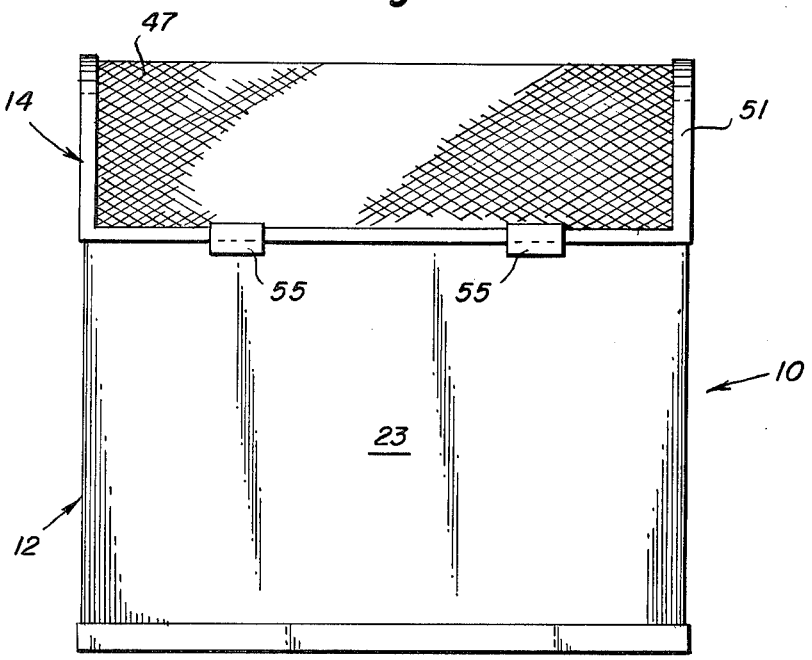
Fig. 5
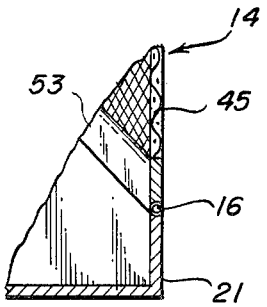
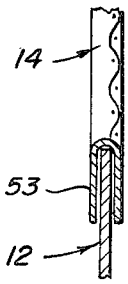
Fig. 4

SAFETY APPARATUS FOR PORTABLE FUEL-BURNING HEATERS

This invention relates to a safety apparatus to be used in conjunction with a portable fuel-burning heater. More particularly, this invention relates to a protective cover or shield for portable kerosene heaters which is conducive to the safer use of such heaters in the home.

BACKGROUND OF THE INVENTION

Kerosene heaters are classifiable as portable zone or space heaters and have recently become very attractive alternatives to the more conventional home space heaters, such as woodburning stoves and fireplaces and portable electric heaters. Their popularity stems from the fact that the heaters are capable of more efficient and higher heat outputs than conventional portable heaters and thus can be used in areas where heat is required allowing the thermostat for the central heating system to be lowered.

Certain hazards are, however, associated with portable kerosene heaters. Principal among them are the danger of fire should the heater be accidentally tipped over or carelessly refueled and the risk of burns and other injuries, particularly to children and pets, when contact is made with such heaters while they are in operation. Damage to clothing, draperies, furniture, fixtures, and the like has also resulted from the use of kerosene heaters in the home. The protective grilles of most, if not all, available heaters, which are typically a framework of chromeplated metal bars, have been found not to be adequate protection in all instances.

SUMMARY OF THE INVENTION

It is, therefore, the primary object of this invention to provide an effective means for obviating the above hazards without interfering with the heat output characteristics of such heaters, thereby allowing safer use of kerosene heating.

It is another object of this invention to provide a safety means for use with kerosene-type heaters which is of relatively simple and durable construction and requires little or no maintenance.

It is still another object of this invention to provide a means for preventing damage to kerosene heaters during storage or non-use.

Other objects of this invention will become apparent in the following description, taken in conjunction with the accompanying drawings.

BRIEF DESCRIPTION OF THE DRAWINGS

FIG. 4 is a cross-sectional view along line 4—4 of FIG. 1.

FIG. 5 is a cross-sectional view along line 5—5 of FIG. 1.

FIG. 6 is a plan view of the rearward side of the apparatus of FIG. 1.

DESCRIPTION OF THE PREFERRED EMBODIMENT OF THE INVENTION

The safety apparatus according to this invention comprises a substantially foraminate, rectangular container which completely encloses and shields a portable fuel-burning heater unit while allowing uninhibited heat flow from the heater to the space or area to be heated. The container includes a substantially pan- or tray-shaped base having a rectangular back wall and side walls which are downwardly sloped from the back wall towards the front edge of the base, a vaulted or dome-shaped cover or lid of foraminous material which includes front and side wall portions complementary with and conforming to the shape of the base to yield a completely enclosable receptacle, and a hinging means connecting the lid to the base along their mating front edges.

Figure 1:
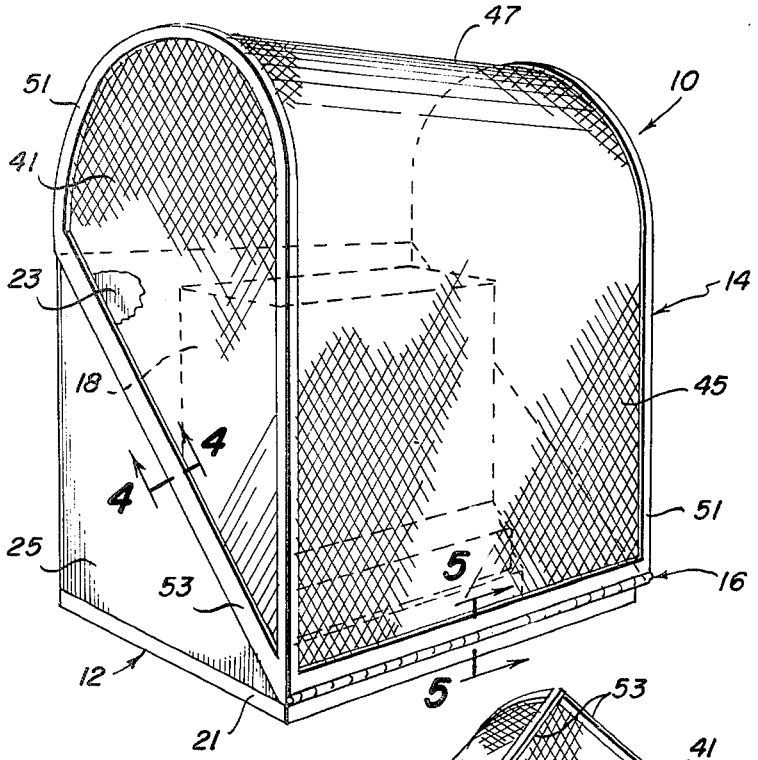
FIG. 1 is a perspective view of safety apparatus in accordance with the instant invention shown with a radiant-type kerosene heater.
Figure 2:
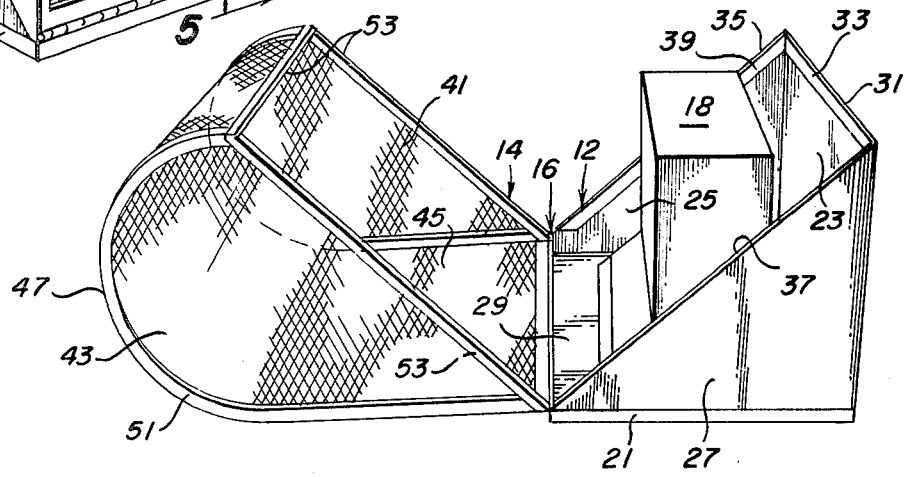
FIG. 2 is a perspective view of the apparatus of FIG. 1 in an opened position.
Figure 3:
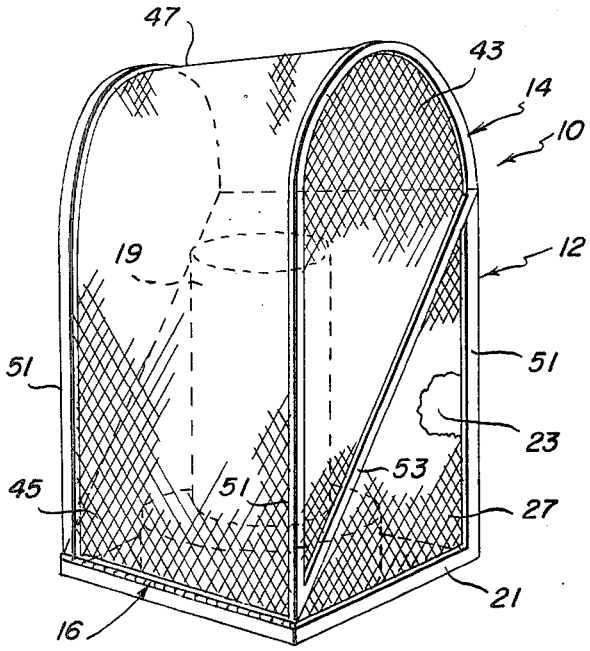
FIG. 3 is a perspective view of another safety apparatus in accordance with the instant invention shown with a convective-type kerosene heater.

With reference to FIGS. 1, 2 and 3, the safety apparatus of the present invention comprises a box-like container 10 including a base member 12 and a lid member 14 connected to base member 12 by hinging means 16. Container 10 should be of suitable dimensions so that it is capable of enclosing any of the commercially available portable kerosene heaters. For example, several varieties of the portable radiant-type heaters being marketed range in overall measurement up to approximately 25×15×20 inches. Thus, for a radiant-type heater 18, such as shown in phantom in FIG. 1, container 10 should have the minimum dimensions required to accommodate a unit of such size. In the practice of this invention, container dimensions of 26×20×29 inches have been found adequate for even the largest radiant heaters. On the other hand, a large convective-type heater 19, as shown in phantom in FIG. 3, is usually columnar in shape requiring a container 10 of somewhat smaller size. Container dimensions of 20×20×34 inches have been found to suitably enclose the various convective-type heaters now on the market.

Turning back to the three figures on sheet 1 of the drawings, base member 12 of container 10 includes a bottom plate 21, a back wall 23, and two obliquely-shaped side walls 25 and 27. Bottom plate 21 is fabricated from sheet metal, preferrably 20 gauge stock, which is formed into the shape of a shallow pan or tray of about one inch in depth. Plate 21, thereby, functions to catch any accidental kerosene spills and effectively prevents the spread of combustion along floors in the event of a fire resulting from spilled fuel.

Bottom plate 21 is of suitable size to permit placement of heater 18 or 19 thereon. Preferably, it should also be large enough to leave a margin 29 of up to several inches from the outer edges of bottom plate 21 to the edge of the heater base so that when container 10 encloses a heater 18 or 19 in operation the burner element of such heater is more remote from items that might otherwise come close to contacting it. The size and weight of bottom plate 21 also adds stability to container 10 providing a low center of gravity, thereby aiding in the prevention of heater tip-overs.

Back wall 23, like bottom plate 21, is made of sheet metal stock and extends perpendicularly from bottom plate 21 substantially one-half to three-quarters of the height dimension of container 10 forming horizontal rim 31. The top edge portion of rim 31 may include a flattened flange 33 to provide reinforcement of wall 23. The bottom edge portion of wall 23 is welded or in some other fashion secured to the rear edge of bottom plate 21. Alternatively, bottom plate 21 and back wall 23 may be formed from a single sheet of metal stock.

Side walls 25 and 27 may also be of sheet metal, as shown in FIGS. 1 and 2. Each wall, however, extends perpendicularly from bottom plate 21 and laterally from back wall 23 to provide forwardly sloping or slanted rims 35 and 37. As with back wall 23, flattened flanges may be formed into the top edge portions of rims 35 and 37, as shown at 39, to increase the strength of the walls. As particularly shown in FIGS. 1 and 2, side walls 25 and 27, along with bottom plate 21 and back wall 23, may be formed from a single sheet of metal stock. Optionally, separate wall portions may be cut and welded or otherwise fastened to bottom plate 21 and back wall 23. In either instance, angle irons (not shown) may be used at the corners formed by back wall 23 and side walls 25 and 27, respectively, to provide a sturdier structure.

Alternatively, and with particular attention to FIG. 3, side walls 25 and 27 may be made of foraminous panels. This option is especially advantageous when container 10 is to be used in conjunction with a convective type heater. That is, because convective-type heaters generate heat in all directions, container 10 should provide more openwork area so as not to hinder the flow of energy from such heaters. The foraminous panels are preferably of expanded metal stock as hereinafter described, and are welded to plate 21 and wall 23 and are reinforced as disclosed above with regard to the sheet metal side walls of FIGS. 1 and 2.

Without regard for the type of portable heater to be enclosed, lid member 14 of container 10 comprises two obliquely-shaped side walls 41 and 43, front wall 45, and vaulted or domeshaped top 47, all of which components are fabricated from foraminous panels which are reinforced along corners and edges by means of a framework of angle irons 51 and bracing 53. Preferred for such panels is 18 gauge expanded metal stock, although other openwork materials may alternatively be employed, such as wire screening, metal grids, etc. The primary requirement for such materials is that they provide a protective mesh for preventing objects from being poked into or near the burner element of the heater or from coming in contact with the hot heater cabinet while allowing uninhibited heat flow from the heater.

Front wall 45 and dome-shaped top 47 are easily shaped from a single sheet of foraminous stock material. On the other hand, side walls 41 and 43 must be cut from sheets of stock so that the upper edge portions are curved in accordance with the semicircular form of the vault or dome and the lower edge portions are shaped to correspond to the slope of side walls 25 and 27 of base member 12. As seen in FIG. 4, bracing 53, which reinforces the side walls of lid member 14, is preferably grooved to receive the sloped rims of the side walls of base member 12. When properly aligned on base 12, the domed or vaulted shape of lid member 14 eliminates sharp, protruding corners, which may be the cause of injury to person or damage to property, and also provides additional protected space above the heater for sensor and/or alarm systems or for articles to be heated. For example, When humified heat is sought, an open pan of water may be conveniently rested on top of the heater while it is in operation.

Turning now to FIG. 5, hinging means 16 connects the lower edge of front wall 45 of lid member 14 to the front edge of bottom plate 21. With the provision of hinging means 16 along the front edge of bottom plate 21, lid portion 14 of container 10 is permitted to be forwardly opened, as shown in FIG. 2, so that easy and convenient access can be had to the interior when container 10 has been placed close to a wall. For example, radiant-type heaters include a reflector element which focuses or targets the heat generated in a forward direction and, consequently, can be positioned in a room with its back facing and in close proximity to a wall or corner, or articles of furniture. Forwardly opening container 10 allows convenient access to the heater in such situations to refuel, ignite, regulate, or extinguish, or to remove, the heater. Hinging means 16 is preferably a continuous or piano-type hinge, as seen in FIGS. 1 and 3, but two, three or more smaller hinges may be employed alternatively.

FIG. 6 illustrates the rear of container 10 according to the present invention showing back wall 23 of base member 12, dome-shaped top 47 of lid member 14, and latching means 55 which secures container 10 in a closed condition. Positive-locking spring latches are preferred.

Optionally, container 10 of the instant invention may include wheels or casters (not shown) mounted to the underside of bottom plate 21 of base member 12 to permit easy movement of the container from place to place within a room or area to be heated.

While the invention has been described and illustrated with reference to certain preferred embodiments, it should be understood that various changes and modifications may be made to the invention as disclosed without departing from the spirit and scope of the invention.

What is claimed is:

1. A safety apparatus for use in conjunction with a portable fuel-burning heater, said apparatus comprising a container which completely encloses said heater, said container including a pan-like base member having a rectangular back wall which extends substantially one-half to three-quarters of the height dimension of said container and obliquely-shaped side walls which are downwardly sloped from said back wall towards the front edge of said base member, a vaulted or domed lid member having foraminous front and side wall portions which conform to and complement the walls of said base member to yield an enclosable receptacle, and hinging means connecting said lid member to said base member along mating front edges.

2. A safety apparatus for use in conjunction with a portable fuel-burning heater, said apparatus consisting essentially of a substantially foraminate container which completely encloses said heater, said container including a pan-shaped base member having a rectangular back wall extending substantially one-half to three-quarters of the height dimension of said container and side walls which are downwardly sloped from said back wall towards the front edge of said base member, a vaulted or dome-shaped lid member of foraminous material including front and side wall portions complementary with and comforming to the shape of said base member to yield a completely encloseable receptacle, and hinging means connecting said lid member to said base member along mating front edges.

3. A safety apparatus for use in conjunction with a portable fuel-burning heater, said apparatus consisting essentially of a substantially foraminate container which completely encloses said heater, said container including a base member comprising a bottom plate formed into the shape of a shallow pan, a rectangular back wall extending perpendicularly from said bottom plate substantially one-half to three-quarters of the height dimension of said container, and side walls extending perpendicularly from said bottom plate and laterally from said back wall to provide forwardly sloping rims, said container further including a lid member fabricated from foraminous panels and comprising a front wall, a dome-shaped top, and two substantially obliquely-shaped side walls having upper edge portions curved in accordance with the semicircular form of the dome and lower edge portions shaped to correspond to said sloping rims of said base member, said container additionally including hinging means connecting the lower edge of said front wall to the front edge of said bottom plate.

4. The apparatus of claim 3 wherein said side walls of said base member are fabricated from sheet metal stock.

5. The apparatus of claim 3 wherein said side walls of said base member are foraminous.

6. The apparatus of claim 3 wherein said side walls of said base member are fabricated from expanded metal stock.

7. The apparatus of claim 3 wherein said lid member is fabricated from expanded metal stock.

8. The apparatus of claim 3 wherein said hinging means is a continuous hinge.

* * * * *